US007602350B2

(12) United States Patent
Leisten

(10) Patent No.: US 7,602,350 B2
(45) Date of Patent: Oct. 13, 2009

(54) DIELECTRICALLY-LOADED ANTENNA

(75) Inventor: Oliver Paul Leisten, Raunds (GB)

(73) Assignee: Sarantel Limited, Wellingborough (GB)

( * ) Notice: Subject to any disclaimer, the term of this patent is extended or adjusted under 35 U.S.C. 154(b) by 168 days.

(21) Appl. No.: 11/975,698

(22) Filed: Oct. 19, 2007

(65) Prior Publication Data

US 2008/0218430 A1 Sep. 11, 2008

Related U.S. Application Data

(60) Provisional application No. 60/920,607, filed on Mar. 28, 2007.

(30) Foreign Application Priority Data

Oct. 20, 2006 (GB) ..... 0620945.6

(51) Int. Cl.
*H01Q 1/36* (2006.01)

(52) U.S. Cl. ..... 343/895

(58) Field of Classification Search ..... 343/895, 343/702, 859–860, 905
See application file for complete search history.

(56) References Cited

U.S. PATENT DOCUMENTS

| | | | | |
|---|---|---|---|---|
| 3,599,220 | A | 8/1971 | Dempsey | |
| 4,608,574 | A | 8/1986 | Webster et al. | |
| 5,594,461 | A * | 1/1997 | O'Neill, Jr. | 343/895 |
| 5,635,945 | A | 6/1997 | McConnell et al. | |
| 5,706,019 | A * | 1/1998 | Darden et al. | 343/895 |
| 5,854,608 | A | 12/1998 | Leisten | |
| 5,859,621 | A | 1/1999 | Leisten | |
| 5,945,963 | A | 8/1999 | Leisten | |
| 5,963,180 | A * | 10/1999 | Leisten | 343/895 |
| 6,011,524 | A * | 1/2000 | Jervis | 343/895 |
| 6,094,178 | A * | 7/2000 | Sanford | 343/895 |
| 6,133,891 | A | 10/2000 | Josypenko | |
| 6,229,488 | B1 | 5/2001 | Lin et al. | |
| 6,300,917 | B1 | 10/2001 | Leisten et al. | |
| 6,369,776 | B1 | 4/2002 | Leisten | |
| 6,552,693 | B1 * | 4/2003 | Leisten | 343/895 |
| 6,690,336 | B1 | 2/2004 | Leisten | |
| 6,886,237 | B2 | 5/2005 | Leisten et al. | |
| 6,914,580 | B2 | 7/2005 | Leisten | |
| 7,002,530 | B1 | 2/2006 | Chung et al. | |
| 7,256,752 | B2 * | 8/2007 | Wither et al. | 343/905 |
| 7,268,745 | B2 | 9/2007 | Yang et al. | |

(Continued)

FOREIGN PATENT DOCUMENTS

| | | |
|---|---|---|
| CN | 2899134 | 5/2007 |

(Continued)

*Primary Examiner*—Huedung Mancuso
(74) *Attorney, Agent, or Firm*—John Bruckner PC

(57) ABSTRACT

A dielectrically-loaded multifilar helical antenna has a ceramic cylindrical core and, on the core outer surface, coextensive generally helical conductors arranged in an opposing configuration. Located on an end surface of the core is a feed connection nodes and a connection structure connecting the helical conductors to the feed connection nodes. The connection structure comprises, as a conductive coating of the core end surface, conductive paths linking a respective helical conductor and a respective feed connection node, the connection structure further comprising a series reactive link in one conductive path and a shunt reactive link interconnecting the feed connection nodes, one of the reactive links being inductive and the other being capacitive to form a matching network.

28 Claims, 3 Drawing Sheets

U.S. PATENT DOCUMENTS

| | | | | |
|---|---|---|---|---|
| 2005/0115056 | A1* | 6/2005 | Leisten et al. | 29/601 |
| 2005/0195126 | A1 | 9/2005 | Leisten | |
| 2006/0022891 | A1 | 2/2006 | O'Neill, Jr. et al. | |
| 2006/0022892 | A1* | 2/2006 | O'Neill et al. | 343/895 |
| 2006/0038739 | A1 | 2/2006 | Feng et al. | |
| 2006/0097950 | A1 | 5/2006 | Wither et al. | |
| 2007/0063918 | A1 | 3/2007 | Leisten | |
| 2007/0063919 | A1 | 3/2007 | Leisten | |

FOREIGN PATENT DOCUMENTS

| | | |
|---|---|---|
| EP | 0469741 | 2/1992 |
| EP | 1076378 | 2/2001 |
| GB | 2292257 | 2/1996 |
| GB | 2424521 | 9/2006 |
| TW | I238566 | 8/1993 |
| WO | WO 00/48268 | 8/2000 |
| WO | WO 2006/136809 | 12/2006 |

* cited by examiner

DIELECTRICALLY-LOADED ANTENNA

CROSS-REFERENCES TO RELATED APPLICATIONS

This application claims a benefit of priority under 35 U.S.C. 119(e) from copending provisional patent application U.S. Ser. No. 60/920,607, filed Mar. 28, 2007, the entire contents of which are hereby expressly incorporated herein by reference for all purposes. This application is related to, and claims a benefit of priority under one or more of 35 U.S.C. 119(a)-119(d) from copending foreign patent application 0620945.6, filed in the United Kingdom on Oct. 20, 2006 under the Paris Convention, the entire contents of which are hereby expressly incorporated herein by reference for all purposes.

BACKGROUND INFORMATION

1. Field of the Invention

This invention relates to a dielectrically-loaded antenna and, primarily, to a quadrifilar helical antenna with a cylindrical dielectric core and an impedance matching structure.

2. Discussion of the Related Art

Dielectrically-loaded antennas and methods for their manufacture are disclosed in the applicant's U.S. Pat. Nos. 5,854,608, 5,945,963, 5,859,621, 6,369,776, 6,690,336, 6,552,693, 6,300,917, 6,886,237, 6,914,580, as well as pending U.S. application Ser. Nos. 09/517,782, 10/987,311, 11/060,215, 11/088,247, 11/472,586 and 11/472,587. The entire contents of these patents and applications are hereby expressly incorporated herein by reference for all purposes.

U.S. Pat. Nos. 5,854,608 and 5,859,621 disclose quadrifilar dielectrically-loaded antennas for operation at frequencies in excess of 200 MHz. Each antenna has two pairs of diametrically opposed helical antenna elements which are plated on a substantially cylindrical electrically insulative core made of a material having a relative dielectric constant greater than 5. The material of the core occupies the major part of the volume defined by the core outer surface. Extending through the core from one end face to an opposite end face is an axial bore containing a coaxial feed structure comprising an inner conductor surrounded by a shielded conductor. At one end of the core the feed structure conductors are connected to respective antenna elements which have associated connection portions adjacent the end of the bore. At the other end of the bore, the shield conductor is connected to a conductor which links the antenna elements and, in these examples, is in the form of a conductive sleeve encircling part of the core to form a balun. Each of the antenna elements terminates on a rim of the sleeve and each follows a respective helical path from its connection to the feed structure.

U.S. Pat. No. 6,369,776 discloses such an antenna in which the shield conductor is spaced from the wall of the bore, preferably by a tube or sleeve of material (preferably plastics) having a relative dielectric constant which is less than half of the relative dielectric constant of the solid material of the core.

Dielectrically-loaded loop antennas having a similar feed structure and balun arrangement are disclosed in U.S. Pat. Nos. 5,954,963, 6,690,336 and 6,300,917. Each of the above antennas has the common characteristic of metallised conductor elements which are disposed about the core and which are top-fed from a feed structure passing through the core. The conductor elements define an interior volume occupied by the core and all surfaces of the core have metallised conductor elements. The balun provides common-mode isolation of the antenna elements from apparatus connected to the feeder structure, making the antenna especially suitable for small handheld devices. One of the objectives in the design of the antennas disclosed in the prior patents is to achieve as near as possible a balanced source or load for the antenna elements. Although the balun sleeve generally serves to achieve such balance, some reactive imbalance may occur owing to constraints on the characteristic impedance of the coaxial feeder structure and on its length. Additional contributing factors are the difference in length between the inner and outer conductors of the feed structure, e.g., as a result of the bent-over part of the inner conductor, and the inherent asymmetry of a coaxial feed. Where necessary, a compensating reactive matching network in the form of a shorted stub has been connected to the inner conductor adjacent the bottom end face of the core, either as part of the device to which the antenna is connected or as a small shielded printed circuit board assembly attached to the bottom end face of the core.

U.S. patent application Ser. No. 11/472,587 discloses a compensating reactive matching network incorporated in a multiple layer printed circuit board seated on the top end face of the core, the board having conductive layers and tracks which form capacitive and inductive elements constituting the matching network. A coaxial feed structure passing through the core is connected to conductors on the board, and the board, in turn, is connected to four coextensive helical antenna elements plated on a cylindrical side surface portion of the core.

Taiwanese Patent No. 1238566 discloses a helical antenna with a ceramic substrate, a matching assisting structure being provided on a top face of the substrate and connected between first and second helical loops for impedance matching adjustment.

It is an object of the invention to provide a practical low-cost alternative to prior dielectrically-loaded antennas with impedance matching structures.

SUMMARY OF THE INVENTION

There is a need for the following embodiments of the invention. Of course, the invention is not limited to these embodiments.

According to the first aspect of this invention, a multifilar helical antenna for operation at a frequency in excess of 200 MHz comprises: an electrically insulative core having a central axis and made of a solid dielectric material which has a relative dielectric constant greater than 5 and which occupies the major part of the interior volume defined by the core outer surface, first and second coextensive generally helical conductors that are in an opposing configuration with respect to each other on a side outer surface portion of the core and, located on an end surface of the core, a pair of feed connection nodes and a connection structure connecting the helical conductors to the feed connection nodes, wherein the connection structure comprises, as a conductive coating of the said core end surface, first and second conductive paths between, respectively, the first helical conductor and one of the feed connection nodes, and the second helical conductor and the other feed connection node, the connection structure further comprising a series reactive link in the first conductive path and a shunt reactive link interconnecting the feed connection nodes, one of the reactive links being inductive and the other being capacitive to form a matching network. In a preferred embodiment of the invention, the shunt reactance link comprises a capacitance and the series reactance link comprises an inductance. The capacitance may be in the form of a chip capacitor conductively bonded to conductive elements of the connection structure that are formed as a coating of the core, or it may comprise an interdigital capacitor formed from conductive areas coating the core end surface. Typically, the inductance is formed as a length of conductive track coating the core end surface.

The antenna may include third and fourth helical conductors, also coextensive with each other and with the first and second helical conductors. In this case, the conductive areas coating the core end surface typically include a first linking conductor interconnecting the first and third helical conductors and a second linking conductor interconnecting the second and fourth helical conductors. The series reactance link may be formed between the first linking conductor and the above-mentioned one feed connection node. The second linking conductor is typically in the form of a sector of a circle which, over the whole of its radial extent, subtends an angle of at least 75° at the core axis. Each linking conductor typically has a part-circular outer edge, the edges being substantially equally radially spaced from the core axis. It is preferred that the core is cylindrical and that the helical elements follow simple helical paths. It will be recognised, however, that helicoidal antenna elements on a non-cylindrical side surface of the core can be used.

The preferred antenna is a backfire device in the sense that it has a feed structure having a pair of feed conductors in an axial passage through the core, connections to the antenna elements being made via conductors on a distal end face of the core. In this preferred embodiment, the shunt reactive link extends around and borders the axial passage to minimise the inductance of the conductive path between the feed connection nodes. It is also preferred that physical symmetry is achieved, e.g. by having two such shunt reactive links located on opposite sides of the axial passage. Thus, in the case of the shunt reactive links being capacitive, they may be formed by a combination of short conductive tracks on the core end surface and chip capacitors soldered to the conductive tracks. In general terms the or each shunt reactive link preferably has at least a major part thereof closer to the axial passage than to the outer edge of the end surface of the core. Similarly, the or each shunt reactive link preferably has at least a major part thereof within a circle of diameter D/2 where D is the diameter of the core or, in the case of a non-cylindrical core, is the average width of the core.

In the case of the series reactive link being inductive, it is preferable to minimise the inductance of the connection between the above-mentioned second connection node and its respective antenna element or elements. Thus, the area of the conductor performing this connection is made larger than that connecting the first connection node to the other antenna element or elements. The inductance of the series reactive link may be provided as a short, comparatively narrow conductive track on the core end surface or, alternatively, as a surface-mount inductor soldered to conductive areas on the core end surface.

According to another aspect of the invention, there is provided a dielectrically-loaded quadrifilar helical antenna for operation at a frequency in excess of 200 MHz comprising: an electrically insulative core having a central axis and made of a solid dielectric material that has a relative dielectric constant greater than 5 and that occupies the major part of the interior volume defined by the core outer surface, first and second pairs of generally coextensive and helical conductors on a side surface portion of the core, a feed structure having a pair of feed conductors in an axial passage through the core, and, located on an end surface of the core a connection structure connecting the helical conductors to the feed structure, wherein the connection structure comprises, as a coating of the said core end surface, (a) first and second linking conductors on opposite sides of the core axis, the first linking conductor interconnecting the first pair of generally helical conductors and the second linking conductor interconnecting the second pair of conductors, the first linking conductor being spaced from the axial passage and the second linking conductor bordering the axial passage where it is connected to one of the feed conductors, and (b) an inductive track extending radially between the first linking conductor and the other feed conductor, the connection structure further comprising a capacitive link extending around and bordering the axial passage to interconnect the inductive track at its connection to the said other feed conductor and the second linking conductor thereby to provide a shunt capacitance across the feed conductors.

According to yet a further aspect of the invention, a dielectrically-loaded multifilar helical antenna for operation at a frequency in excess of 500 MHz comprises: an electrically insulative core of a solid material having a relative dielectric constant greater than 10, and a conductive antenna element structure on an outer surface of the core, wherein the core has a central axis and its outer surface has a side portion that encircles the axis and end portions that extend transversely with respect to the axis, the major part of the volume defined by the outer surface being occupied by the solid dielectric material. The antenna element structure comprises first and second pairs of elongate helical conductors and are bonded to the core outer surface side portion. The antenna further comprises, on one of the core outer surface end portions, first and second feed nodes in a central region and a connecting network that connects the helical conductors to the feed nodes and includes a conductor pattern formed as a conductive layer bonded on the said outer surface end portion, the conductor pattern comprising a first link interconnecting the helical conductors of the first pair, a second link interconnecting the helical conductors of the second pair. The first link is spaced from the feed nodes and is connected to the first feed node by a conductor track that extends generally radially outwardly with respect to the central region to act as a series inductance between the first pair of helical conductors and the first feed node. The connecting network further comprises a capacitive link located to the side of the central region to interconnect the second linking conductor and the inductive track at its connection to the first feed node thereby to form a shunt capacitance across the feed nodes.

The invention also includes a dielectrically-loaded multifilar helical antenna for operation at a frequency in excess of 200 MHz comprising: an electrically insulative core having a central axis and made of a solid dielectric material which has a relative dielectric constant greater than 5 and which occupies the major part of the interior volume defined by the core outer surface, first and second coextensive and helical conductors that are laterally opposite each other on a side surface portion of the core, a feed structure having a pair of feed conductors in an axial passage through the core, and, located on an end surface of the core a connection structure connecting the helical conductors to the feed structure, wherein the connection structure comprises, as a coating of the said core end surface, first and second conductive paths between, respectively, the first helical conductor and one of the feed conductors and the second helical conductor and one of the feed conductors, the connection structure further comprising an inductive element in the first conductive path which results in the first conductive path having a higher series inductance than the second conductive path, and a capacitive link extending around and bordering the axial passage to connect the node formed by the interconnection of the inductive element and the respective feed conductor to a conductor of the second conductive path.

BRIEF DESCRIPTION OF THE DRAWINGS

The invention will now be described by way of example with reference to the drawings in which:—

DESCRIPTION OF PREFERRED EMBODIMENTS

Figure 1:
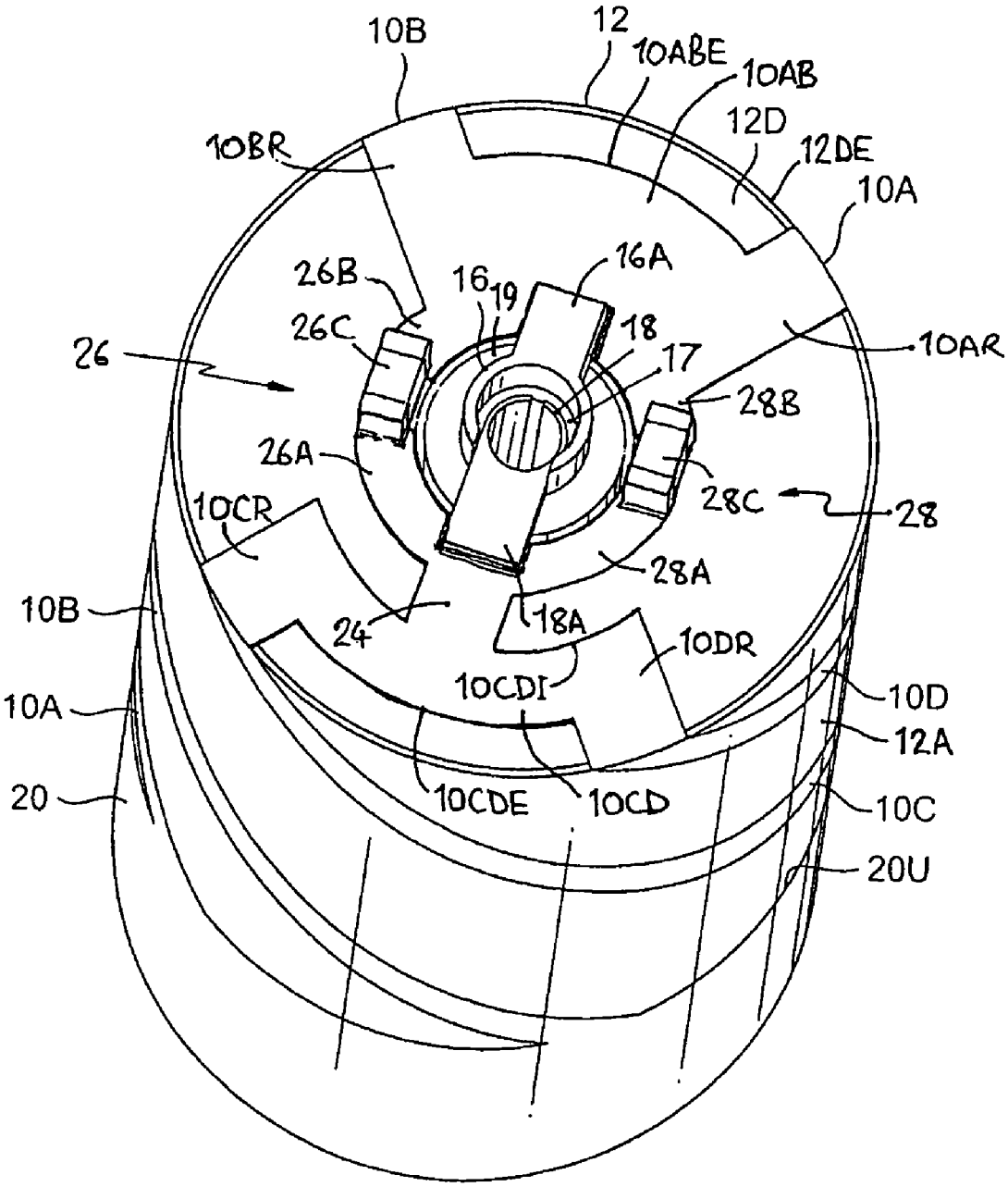
FIG. 1 is a top perspective view of a quadrifilar helical antenna in accordance with the invention.
Figure 2:
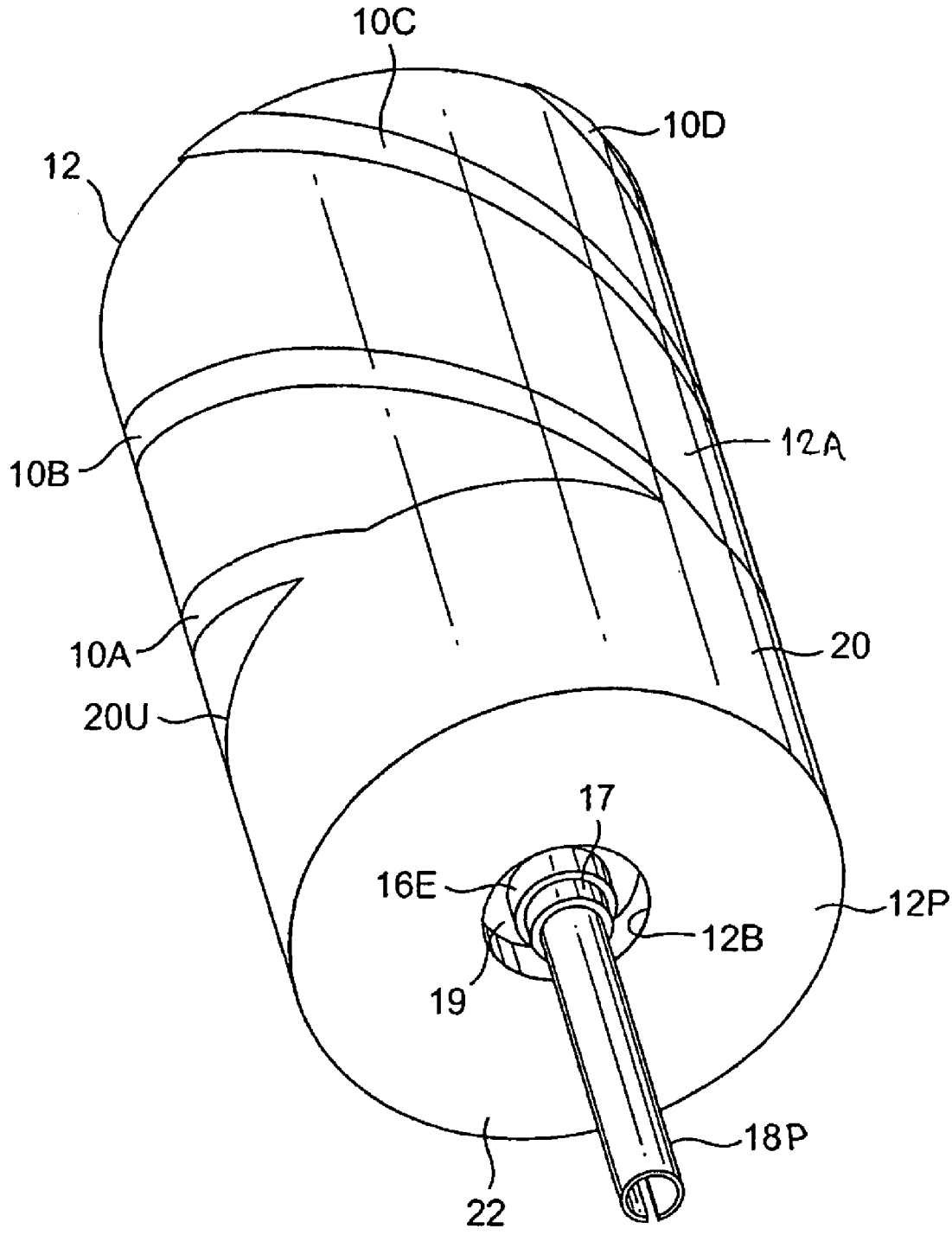
FIG. 2 is another perspective view of the antenna, seen from one side and from below.

Referring to FIGS. 1 and 2, a dielectrically-loaded antenna has an antenna element structure with four axially coextensive helical conductive tracks 10A, 10B, 10C, 10D plated on a side outer surface portion 12A of a cylindrical ceramic core 12.

The core has an axial passage in the form of a bore 12B extending through the core 12 from a distal end surface portion 12D to a proximal end surface portion 12P. Both of these surface portions are planar faces perpendicular to the central axis of the core. They are oppositely directed, in that one is directed distally and the other proximally in this embodiment Housed within the bore 12B is a coaxial feed structure having a conductive tubular outer shield conductor 16, an insulating layer 17 and an elongate conductive inner conductor 18 insulated from the outer shield conductor by the insulating layer 17. Surrounding the shield conductor is a dielectric insulative sleeve 19 formed as a tube of plastics material of predetermined relative dielectric constant the value of which is less than the dielectric constant of the material of the ceramic core 12. The sleeve 19 acts as a spacer spacing the outer shield conductor 16 from the wall of the bore 12B.

The combination of the shield conductor 16, inner conductor 18 and insulative layer 17 constitutes a feed structure of predetermined characteristic impedance, typically 50 ohms, passing through the antenna core 12 for coupling the distal ends of the antenna elements 10A to 10D to radio frequency (RF) circuitry of equipment to which the antenna is to be connected. Connections between the antenna elements 10A to 10D and the feed structure are made via a connection structure including conductive connection portions associated with the helical tracks 10A to 10D, these connection portions being formed as radial tracks 10AR, 10BR, 10CR, 10DR plated on the distal end face 12D of the core 12 and each extending inwardly from a distal end of the respective helical track. The connection structure forms a matching network, as will be described hereinafter.

The proximal ends of the antenna elements 10A-10D are connected to a common virtual ground conductor 20 in the form of a plated sleeve surrounding a proximal end portion of the core 12. The proximal end surface portion 12P of the core is also plated, the conductor 22 so formed being connected at that proximal face 12P to an exposed portion 16E of the shield conductor 16 by a ferrule (not shown) over the exposed proximal end portion 16E. The ferrule is a push fit on the shield component 16 or is crimped to it. Solder, applied as paste on the plating 22 immediately adjacent the proximal end of the bore 12B connects the ferrule to the plating 22 when the antenna is passed through a solder reflow oven during assembly.

The four helical antenna elements 10A to 10D are of different lengths, two of the elements 10B, 10D being longer than the other two 10A, 10C as a result of the rim 20U of the sleeve 20 being of varying distance from the proximal end face 12P of the core. The first two elements 10B, 10D form one laterally opposed pair and the second two elements 10A, 10C form another laterally opposed pair. Where antenna elements 10A and 10C are connected to the sleeve 20, the rim 20U is a little further from proximal face 12P than where the antenna elements 10B and 10D are connected to the sleeve 20.

The conductive sleeve 20, the plating 22 and the outer shield 16 of the feed structure together form a quarter wave balun which provides common-mode isolation of the antenna element structure from the equipment to which the antenna is connected when installed. The outer surface portions of the core define an interior volume the major part of which is occupied by the core material.

The differing lengths of the antenna elements 10A to 10D result in a phase difference between currents in the longer elements 10B, 10D and those in the shorter elements 10A, 10C respectively when the antenna operates in a mode of resonance in which the antenna is sensitive to circularly polarised signals. In this mode, currents flow around the rim 20U between, on the one hand, the elements 10C and 10D connected to the inner feed conductor 18, and on the other hand, the elements 10A, 10B connected to the shield 16, the sleeve 20 and plating 22 acting, at the operating frequency, as a trap preventing the flow of currents from the antenna elements 10A-10D to the shield 16 at the proximal end face 12P of the core. It will be noted that the helical tracks 10A-10D are interconnected in pairs by part-annular tracks 10AB and 10CD which form linking conductors between the inner ends of the respective radial tracks 10AR, 10BR and 10CR, 10DR so that each pair of helical tracks has one long track 10B, 10D and one short track 10A, 10C. Operation of quadrifilar dielectrically loaded antennas having a balun sleeve is described in more detail in the above-mentioned U.S. Pat. Nos. 5,854,608 and 5,859,621.

The feed structure performs functions other than simply conveying signals to or from the antenna element structure. Firstly, as described above, the shield conductor 16 acts in combination with the sleeve 20 to provide common-mode isolation at the point of connection of the feed structure to the antenna element structure. The length of the shield conductor between (a) its connection with the plating 22 on the proximal end face 12P of the core and (b) its connection to the antenna element connection portions 10AR, 10BR, together with the dimensions of the bore 12B and the dielectric constant of the material filling the space between the shield 16 and the wall of the bore, are such that the electrical length of the shield 16 on its outer surface is, at least approximately, a quarter wavelength at the frequency of the required mode of resonance of the antenna, so that the combination of the conductive sleeve 20, the plating 22 and the shield 16 promotes balanced currents at the connection of the feed structure to the antenna element structure.

Typically, the relative dielectric constant of the insulating layer 17 surrounding the shield 16 of the feed structure is between 2 and 5. One suitable material, PTFE, has a relative dielectric constant of 2.2. Alternatively, the space between the shield 16 and the wall of the bore 12B may be left as an air gap. Whether the layer 17 is an insulative solid material or air, its relatively low dielectric constant diminishes the effect of the core 12 on the electrical length of the shield 16 and, therefore, on any longitudinal resonance associated with the outside of the shield 16. Since the mode of resonance associated with the required operating frequency is characterised by voltage dipoles extending diametrically, i.e. transversely, of the cylindrical core axis, the effect of the low dielectric constant sleeve on the required mode of resonance is relatively small due to the sleeve thickness being, at least in the preferred embodiment, considerably less than that of the core. It is, therefore, possible to cause the linear mode of resonance associated with the shield 16 to be de-coupled from the wanted mode of resonance.

The antenna has a main resonant frequency of 500 MHz or greater, the resonant frequency being determined by the effective electrical lengths of the antenna elements and, to a lesser degree, by their width. The lengths of the elements, for a given frequency of resonance, are also dependent on the relative dielectric constant of the core material, the dimensions of the antenna being substantially reduced with respect to an air-cored quadrifilar antenna.

One preferred material of the antenna core 12 is a zirconium-tin-titanate-based material. This material has the above-mentioned relative dielectric constant of 36 and is noted also for its dimensional and electrical stability with varying temperature. Dielectric loss is negligible. The core may be produced by extrusion or pressing, and sintering.

The antenna is especially suitable for L-band GPS reception at 1575 MHz. In this case, the core 12 has a diameter of about 10 mm and the longitudinally extending antenna elements 10A-10D have an average longitudinal extent (i.e. parallel to the central axis) of about 12 mm. At 1575 MHz, the length of the conductive sleeve 20 is typically in the region of 5 mm. Precise dimensions of the antenna elements 10A to 10D can be determined in the design stage on a trial and error basis by undertaking eigenvalue delay measurements until the required phase difference is obtained. The diameter of the feed structure in the bore 12B is in the region of 2 mm.

Further details of the feed structure will now be described. Referring to FIG. 1, the outer shield 16 has an integral laterally outwardly extending connection member at its distal end in the form of a radial tab 16A. The tubular body of the shield 16 and the tab 16A are integrally formed as a single piece, monolithic component. In this embodiment, the shield 16, including its tab 16A comprise a moulded plastics component plated with a conductive material. That is, at least the outer surface of the rod-shaped part of the shield component and the proximal surface of the tab 16A are conductively plated to form a conductive shield and associated connecting member. The shield 16 also has an outwardly directed cut-out in its distal end portion, the cut-out being directed oppositely with respect to the tab 16A away from the central axis. The insulative layer 17 is formed as a simple plastics tube, dimensioned to be a close fit within the central bore of the shield component 16, its length being such that, when located inside the shield component 16, one end is located just short of the distal end of the shield component, but projects from the proximal end of shield 16.

Referring to FIGS. 1 and 2, the conductive inner component 18 is a tube which is split lengthways and is made of a resilient conductive material. The outer diameter of the tube when formed is larger than the inner diameter of the insulating layer 17 so that it grips and closely fits the inner wall of the tube forming the insulating layer 17 when compressed and inserted in the latter. This inner component 18 also has an integral laterally outwardly extending connection member 18A formed at its distal end, the connection member being a radial tab which is received in the cut-out of the shield 16 so as to project radially outwardly from the axis of the feed structure, when assembled, in a direction 180° opposite to the projecting direction of the shield tab 16A, as shown in FIG. 1. The tabs 16A and 18A are of a length sufficient to bridge the insulative sleeve 19 and to overlap the respective conductive portions of the connection structure coated on the end face 12D of the core 12 when the feed structure is inserted in the bore 12D. The proximal surfaces of the tabs, i.e. the surfaces which face the other end of the feed structure, lie in a common plane so that when the feed structure is inserted in the bore 12B, both surfaces bear against the conductive portions plated on the distal end surface 12D of the core 12.

Further details of the connection structure will now be described. Referring to FIG. 1, two of the helical elements 10A, 10B are interconnected by a first linking conductor 10AB on the distal core surface portion 12D, linking the respective radial connection portions 10AR, 10BR. This linking conductor 10AB extends from an arcuate edge 10ABE close to the edge 12DE of the end surface portion 12D to an inner edge bordering the bore 12B at its intersection with the surface portion 12D. The side edges of the linking conductor 10AB are aligned with edges of the radial connection portions 10AR, 10BR with the result that linking conductor 10AB has a fan shape approximately to a sector of a circle. In this embodiment, it subtends an angle of about 90° at a point in the region of the core axis. Since the tab 16A of the shield conductor 16 overlies the linking conductor 10AB adjacent the bore 12B, the shield conductor 16 is connected directly to the respective two helical elements 10A, 10B when the antenna is assembled (solder paste being applied around tab 16A and subsequently heated during assembly of the antenna). The fan shape of the linking conductor, in addition to minimising the inductance between the respective helical elements 10A, 10B and the outer feed conductor 12, tends to distribute currents for improved efficiency.

The other two helical elements 10C, 10D are also interconnected by a linking conductor 10CD which links the respective radial connection portions 10CR, 10DR. This linking conductor also has an outer arcuate edge 10CDE close to the outer edge 10DE of the distal end surface portion 12D of the core 12. Indeed, this arcuate edge 12CDE is at the same radius as the arcuate edge 10ABE of the other linking conductor 12AB. However, in this case, the linking conductor 10CD has an arcuate inner edge 10CDI of a radius such that it lies at an intermediate position between the bore 12B and the outer edge 12DE of the distal surface portion 12D. Between the tab 18A of the inner feed conductor 18 and a central part of the linking conductor 10CD, there is a plated radial link 24 which acts as a series inductance between the inner conductor 18 and the linking conductor 10CD when the tab 18A is soldered to an inner portion of the link 24. Owing to the much greater width of the sector-shaped linking conductor 10AB compared with the width of link 24, the inductance between the shield 16 and the helical elements 10A and 10B is much less than that between the inner conductor 18 and the helical elements 10C, 10D. The inductive link 24, therefore, acts as a series reactive link in the conductive path between the inner feed conductor 18 and the helical elements 10C, 10D.

The connection structure also provides a shunt reactance link structure in the form of two shunt reactance links 26, 28 between the feed connection nodes represented by the feed conductor tabs 16A, 18A and their associated underlying conductive portions.

Thus, each shunt reactance link 26, 28 connects the inner end of the inductive link 24, i.e. the end opposite the linking conductor 10CD, to an inner portion of the other linking conductor 10AB. Each shunt reactance link 26, 28 comprises part-annular track portions 26A, 26B, 28A, 28B adjoining the edge of the opening formed by the intersection of the bore 12B and the distal end core surface portion 12D. In each link 26, 28 there is a gap between the respective part-annular tracks which is bridged by a respective chip capacitor 26C, 28C. The dimensions of the tracks 26A, 26B, 28A, 28B and the chip capacitors 26C, 28C and their closeness to the central axis of the core 12 are such that each shunt reactance link lies within a circle of diameter D/2 where D is the outer diameter of the core 12. In this way, the length of the conductive tracks 26A, 26B, 28A, 28B is kept to a minimum to minimise their inductances.

In an antenna for GPS, i.e. having an operating frequency in the region of 1575 MHz, the total shunt capacitance across the feed connection nodes is in the region of 12.5 pF, whilst the series inductance between the feed connection node associated with the inner conductor of the feed structure and the linking conductor 10CD associated with the respective helical antenna elements 10C, 10D is in the region of 0.5 nH. In general terms, the capacitance and inductance are, respectively, in the ranges of from 1 pF to 20 pF and 0.1 nH to 1.0 nH, with ranges of from 3 pF to 15 pF and 0.2 nH to 0.7 nH being typical.

The matching network formed by the connection structure, as described above, produces a substantially resistive 50 ohm source impedance for the feed structure 16, 17, 18 at frequencies in the region of the operating frequency of the antenna.

Figure 3:
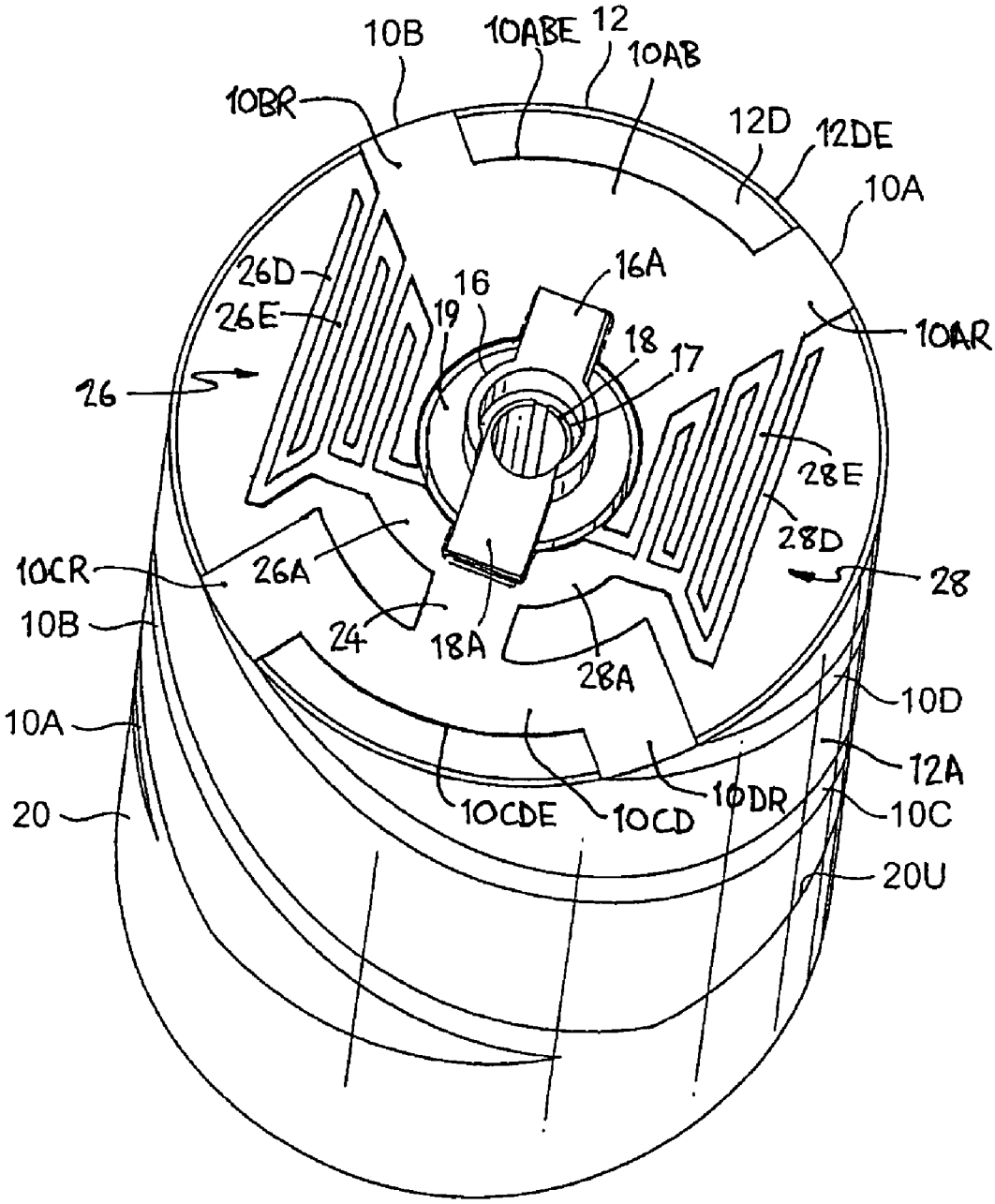
FIG. 3 is a top perspective view of a second quadrifilar helical antenna in accordance with the invention.

Depending on the size of the antenna, which is governed, at least in part, by the frequency of operation and the relative dielectric constant of the core 12, the total capacitance of the shunt reactance link structure may be sufficiently small that interdigital capacitors formed by conductive portions plated directly on the distal end surface portion 12D of the core 12 can be used, as shown in FIG. 3. In this case, each shunt reactance link 26, 28 comprises (i) a part-annular track 26A, 28A plated on the core surface in a position bordering the bore 12B, (ii) a first set 26D, 28D of plated conductive fingers connected to the part-annular track 26A, 28A, and (iii) a second set 26E, 28E of plated conductive fingers that are parallel to the conductive fingers of the first set 26D, 28D but spaced therefrom in the spaces between the latter. The fingers of each second set 26E, 28E are connected to the plated conductive area formed by the linking conductor 10AB between the helical conductors 10A, 10B associated with the outer conductor 18 of the feeder structure. Again, the shunt reactance links 26, 28 so formed are arranged so as to be as close as possible to the bore 12B. In this case, therefore, the major part of each link, represented by the respective part-annular track 26A, 28A and the interdigital capacitor 26D, 26E, 28D, 28E lies, is closer to the axial bore 12B than to the outer edge 12DE of the distal end surface portion of the core.

In other respects, the connection structure of this second antenna in accordance with the invention corresponds to that of the embodiment described above with reference to FIGS. 1 and 2, in that it has a series inductive link formed by a narrow conductive track 24, linking conductors 10AB, 10CD with equal-radius outer edges, and a feed structure with laterally extending feed connection tabs 16A, 18A the proximal connecting surfaces of which are soldered to the underlying conductor portions of the connecting structure plated on the distal surface portion 12D of the core 12.

It will be appreciated that, where relatively small capacitor values (e.g. between 1 pF to 5 pF) can be tolerated, the use of interdigital capacitors such as those described above can result in a lower manufacturing cost.

It is not essential that the series and shunt reactive links are respectively inductive and capacitive. The shunt link may be inductive and the series link capacitive. In such a case particularly, the shunt inductive link is likely to require at least one discrete surface-mounted inductor component rather than simply one or more plated inductive tracks, depending on the required operating frequency.

The invention claimed is:

1. A dielectrically loaded mutifilar helicalantenna for operation at a frequency in excess of 200 MHz comprising: an electrically insulative core having a central axis and made of a solid dielectric material which has a relative dielectric constant greater than 5 and which occupies the major part of the interior volume defined by the core outer surface first and second coextensive generally helical conductors that are in an opposing configuration with respect to each other on a side outer surface portion of the core and, located on an end surface of the core, a pair of feed connection nodes and a connection structure connecting the helical conductors to the feed connection nodes, wherein the connection structure comprises, as a conductive coating of the said core end surface, first and second conductive paths between, respectively, the first helical conductor and one of the feed connection nodes, and the second helical conductor and the other feed connection node, the connection structure further comprising a series reactive link in the first conductive path and a shunt reactive link interconnecting the feed connection nodes, one of the reactive links being inductive and the other being capacitive to form a matching network.

2. An antenna according to claim 1, wherein the shunt reactance link comprises a capacitance and the series reactance link comprises an inductance.

3. An antenna according to claim 1 or claim 2, wherein the capacitance is a chip capacitor conductively bonded to conductive elements of the connection structure that are formed as a coating of the core.

4. An antenna according to claim 1 or claim 2, wherein the capacitance comprises an interdigital capacitor formed from conductive areas coating the said core end surface.

5. An antenna according to any of claims 1 or 2, wherein the inductance is formed as a length of conductive track coated on the said core end surface.

6. An antenna according to any of claims 1 or 2, having third and fourth helical conductors which are coextensive with the first and second helical conductors, and, formed as conductive areas coating the said core end surface, a first linking conductor interconnecting the first and third helical conductors and a second linking conductor interconnecting the second and fourth helical conductors, wherein the series reactance link is formed between the first linking conductor and the said one feed connection node.

7. An antenna according to claim 6, wherein the second linking conductor is in the general form of a sector of a circle and, over the whole of its radial extent, subtends an angle of at least 75° at the core axis.

8. An antenna according to any of claims 1 or 2, wherein the core is cylindrical and wherein each linking conductor has a part-circular outer edge, which edges are substantially equally radially spaced from the core axis.

9. An antenna according to any of claims 1 or 2, further comprising a feed structure having a pair of feed conductors in an axial passage through the core, wherein the shunt reactive link extends around and borders the axial passage.

10. An antenna according to claim 9, having two shunt reactive links each extending around and bordering the axial passage and each providing a reactive interconnection between the feed connection nodes, the shunt reactive links being located on opposite sides of the axial passage.

11. An antenna according to claim 10, wherein both shunt reactive links are capacitive.

12. An antenna according to claim 9, wherein the or each shunt reactive link has at least a major part thereof closer to the axial passage than to the outer edge of the said end surface of the core.

13. An antenna according to claim 9, wherein the or each shunt reactive link has at least a major part thereof within a circle of diameter D/2 where D is the average width of the core.

14. A dielectrically loaded quadrifilar helical antenna for operation at a frequency in excess of 200 MHz comprising: an electrically insulative core having a central axis and made of a solid dielectric material that has a relative dielectric constant greater than 5 and that occupies the major part of the interior volume defined by the core outer surface, first and second pairs of generally coextensive and helical conductors on a side surface portion of the core, a feed structure having a pair of feed conductors in an axial passage through the core, and, located on an end surface of the core a connection structure connecting the helical conductors to the feed structure, wherein the connection structure comprises, as a coating of the said core end surface, (a) first and second linking conductors on opposite sides of the core axis, the first linking conductor interconnecting the first pair of generally helical conductors and the second linking conductor interconnecting the second pair of conductors, the first linking conductor being spaced from the axial passage and the second linking conductor bordering the axial passage where it is connected to one of the feed conductors, and (b) an inductive track extending radially between the first linking conductor and the other feed conductor, the connection structure further comprising a capacitive link extending around and bordering the axial passage to interconnect the inductive track at its connection to the said other feed conductor and the second linking conductor thereby to provide a shunt capacitance across the feed conductors.

15. An antenna according to claim 14, wherein the capacitive link comprises a capacitor bonded to the conductive coating on the core end surface such that one terminal of the capacitor is connected to the node formed by the interconnection of the inductive track and the respective conductor, and the other terminal of the capacitor is connected to the second linking conductor.

16. An antenna according to claim 14, wherein the capacitive link comprises an interdigital capacitor plated on the core end surface.

17. An antenna according to any of claims 14 to 16, comprising two capacitive links each extending around and bordering the axial passage and each capacitively interconnecting the second linking conductor and the inductive track at its connection to the said other feed conductor, the capacitive links being formed on opposite sides of the axial passage.

18. An antenna according to any of claims 14 to 16, wherein the or each capacitive link includes a part-annular conductive track and a capacitive element, the part-annular track being a coated element on the core, being located adjacent the axial passage and interconnecting the capacitive element and the inductive track at its connection to the said other feed conductor.

19. An antenna according to any of claims 14 to 16, wherein the ratio of the axial extent of the helical conductors to the diameter of the core is between 0.6 and 3.

20. An antenna according to any of claims 14 to 16, wherein the axial extent of the helical conductors is equal to or less than the diameter of the core.

21. An antenna according to any of claims 14 to 16, wherein the feed structure comprises a coaxial transmission line having an inner conductor and an outer conductor, both of which have integrally formed lateral extensions bonded respectively to an inner end portion of the inductive track and an inner portion of the second linking conductor.

22. A dielectrically loaded multifilar helical antenna for operation at a frequency in excess of 500 MHz comprising: an electrically insulative core of a solid material having a relative dielectric constant greater than 10, and a conductive antenna element structure on an outer surface of the core, wherein: the core has a central axis and its outer surface has a side portion that encircles the axis and end portions that extend transversely with respect to the axis, the major part of the volume defined by the outer surface being occupied by the solid dielectric material; the antenna element structure comprises first and second pairs of elongate helical conductors that are bonded to the core outer surface side portion; and the antenna further comprises, on one of the core outer surface end portions, first and second feed nodes in a central region and a connecting network that connects the helical conductors to the feed nodes and includes a conductor pattern formed as a conductive layer bonded on the said outer surface end portion, the conductor pattern comprises a first link interconnecting the helical conductors of the first pair, a second link interconnecting the helical conductors of the second pair, the first link being spaced from the feed nodes and being connected to the first feed node by a conductor track that extends generally radially outwardly with respect to the central region to act as a series inductance between the first pair of helical conductors and the first feed node, and wherein the connecting network further comprises a capacitive link located to the side of the central region to interconnect the second linking conductor and the inductive track at its connection to the first feed node thereby to form a shunt capacitance across the feed nodes.

23. An antenna according to claim 22, wherein the capacitive link comprises a branch conductor forming, as part of the said conductive layer, a branch off the inductive track at the first feed node, and a capacitive element connected between the branch and the second linking conductor.

24. An antenna according to claim 23, wherein the capacitive element comprises a capacitor bonded to the conductive layer adjacent the central region.

25. An antenna according to claim 23, wherein the capacitive element comprises an interdigital capacitor integrally formed as part of the conductive layer.

26. An antenna according to any of claims 23 to 25, comprising two capacitive links on opposite sides of the core axis, each capacitively interconnecting the feed nodes.

27. An antenna according to any of claims 23 to 25, wherein the core is cylindrical and the end portions include end surfaces extending transversely with respect to the central axis, and wherein the or each capacitive element is located on the one of the end surfaces at least partly within a circle of diameter D/2 centred on the axis, D being the diameter of the core.

28. A dielectrically loaded multifilar helical antenna for operation at a frequency in excess of 200 MHz comprising: an electrically insulative core having a central axis and made of a solid dielectric material which has a relative dielectric constant greater than 5 and which occupies the major part of the interior volume defined by the core outer surface, first and second coextensive and helical conductors that are laterally opposite each other on a side surface portion of the core, a feed structure having a pair of feed conductors in an axial passage through the core, and, located on an end surface of the core, a connection structure connecting the helical conductors to the feed structure, wherein the connection structure comprises, as a coating of the said core end surface, first and second conductive paths between, respectively, the first helical conductor and one of the feed conductors and the second helical conductor and one of the feed conductors, the connection structure further comprising an inductive element in the first conductive path which results in the first conductive path having a higher series inductance than the second conductive path, and a capacitive link extending around and bordering the axial passage to connect the node formed by the interconnection of the inductive element and the respective feed conductor to a conductor of the second conductive path.

* * * * *